US008226419B2

(12) United States Patent
Fonzo

(10) Patent No.: US 8,226,419 B2
(45) Date of Patent: Jul. 24, 2012

(54) COMPUTER PORT INTERFACE HAVING COMPOUND SWIVEL

(75) Inventor: Christopher Vincent Fonzo, San Marcos, CA (US)

(73) Assignee: Sierra Wireless, Inc., Richmond, British Columbia (CA)

( * ) Notice: Subject to any disclaimer, the term of this patent is extended or adjusted under 35 U.S.C. 154(b) by 0 days.

(21) Appl. No.: 12/892,213

(22) Filed: Sep. 28, 2010

(65) Prior Publication Data

US 2011/0076873 A1 Mar. 31, 2011

Related U.S. Application Data

(60) Provisional application No. 61/246,899, filed on Sep. 29, 2009.

(51) Int. Cl.
*H01R 39/00* (2006.01)

(52) U.S. Cl. ..... 439/11; 439/31

(58) Field of Classification Search ..... 439/11, 439/31

See application file for complete search history.

(56) References Cited

U.S. PATENT DOCUMENTS

| | | | | |
|---|---|---|---|---|
| 4,037,978 | A | 7/1977 | Connelly | |
| 5,018,980 | A * | 5/1991 | Robb | 439/8 |
| 5,484,220 | A | 1/1996 | Lewis et al. | |
| 5,529,421 | A | 6/1996 | Epkens | |
| 5,685,661 | A | 11/1997 | Marka et al. | |
| 5,772,350 | A | 6/1998 | Ferguson et al. | |
| 5,839,846 | A | 11/1998 | Shimada et al. | |
| 6,338,645 | B1 * | 1/2002 | Tan et al. | 439/446 |
| 6,357,710 | B1 * | 3/2002 | Fielden et al. | 248/276.1 |
| 6,544,075 | B1 | 4/2003 | Liao | |
| 6,551,142 | B2 | 4/2003 | Eisenbraun | |
| 6,612,874 | B1 | 9/2003 | Stout et al. | |
| 6,644,999 | B1 * | 11/2003 | Tan et al. | 439/446 |
| 6,786,734 | B2 * | 9/2004 | Yu | 439/11 |
| 6,893,267 | B1 * | 5/2005 | Yueh | 439/8 |
| 7,113,812 | B2 | 9/2006 | Li | |
| 7,128,615 | B1 * | 10/2006 | Liao | 439/640 |
| 7,172,428 | B2 | 2/2007 | Huang | |
| 7,435,090 | B1 | 10/2008 | Schriefer et al. | |
| 7,811,136 | B1 * | 10/2010 | Hsieh et al. | 439/640 |
| 2002/0081878 | A1 * | 6/2002 | Bruno | 439/164 |

(Continued)

OTHER PUBLICATIONS

"Verizon's UM150 USB EVDO Rev-A Modem—First Impressions," Nov. 2007, 7 pages, EVDOinfo.com, www.evdoinfo.com/content/view/2161/64/.

(Continued)

*Primary Examiner* — James Harvey
(74) *Attorney, Agent, or Firm* — Fanelli Haag & Kilger PLLC

(57) ABSTRACT

The present invention provides a computer port interface apparatus having a compound swivel. The apparatus comprises: a computer port connector portion configured for mated coupling with a computer port, a compound swivel portion, and a peripheral portion operatively coupled to the computer port connector portion. The peripheral portion may include an integral peripheral device or a connector for mated coupling with a device. The computer port connector portion and peripheral portion extend at angles from opposing ends of the compound swivel portion. The compound swivel portion comprises two or more swivels in series. Each swivel is operatively coupled to a swivel stop assembly configured to limit relative rotation of the swivel to a predetermined range. Swivelling allows reorientation of the peripheral portion and a device coupled thereto to facilitate operation. Swivel stop assemblies protect portions of the apparatus and/or facilitate operation.

19 Claims, 9 Drawing Sheets

U.S. PATENT DOCUMENTS

| | | | | |
|---|---|---|---|---|
| 2004/0105329 | A1* | 6/2004 | Lin et al. | 365/202 |
| 2004/0229478 | A1 | 11/2004 | Chen | |
| 2006/0044747 | A1 | 3/2006 | Chen | |
| 2006/0160377 | A1* | 7/2006 | Huang | 439/31 |
| 2008/0308755 | A1* | 12/2008 | Hashizume et al. | 250/553 |
| 2009/0208274 | A1 | 8/2009 | Liang | |
| 2011/0076873 | A1* | 3/2011 | Fonzo | 439/485 |

OTHER PUBLICATIONS

"The Best Cellular Broadband Devices—Verizon Wireless UM150—At A Glance—Reviews by PC Magazine," Jan. 2008, 3 pages, PC Magazine, www.pcmag.com.

"USB HSDPA Modem," Oct. 2006, 3 pages, Digadget.com, www.digadget.com.

* cited by examiner

COMPUTER PORT INTERFACE HAVING COMPOUND SWIVEL

CROSS-REFERENCE TO RELATED APPLICATIONS

The following application claims the benefit of U.S. Provisional Patent Application No. 61/246,899, filed Sep. 29, 2009, the disclosure of which is incorporated by reference herein in its entirety.

FIELD OF THE INVENTION

The present invention pertains in general to computer port interfaces and in particular to a computer port interface having a compound swivel.

BACKGROUND

Computer devices, such as laptops, desktops, notebooks, netbooks, PDAs, hand-held devices, digital cameras, cell phones, and the like, are often equipped with wired data and/or power ports for providing interconnectivity with other computer devices or peripheral devices. Peripheral devices may include solid-state memory, security "dongles," network interfaces, input interfaces such as wired or wireless mouse or keyboard interfaces, microphones, cameras, and the like. Examples of current industry standard computer ports include USB™ types A, B, mini-A, mini-B, micro-AB and micro-B, Firewire™ ports, and the like. Although flexible cables may typically be used to provide connectivity to a port, such cables may lack desired features, such as providing structural support for a peripheral device attached to a host computer device.

For example, current laptop computers typically include one or more USB™ ports which may be used to connect a peripheral such as a USB™ wireless network interface peripheral. Such network interface peripherals may be contained within a generally compact "stick" type housing, which may be plugged directly into the laptop's USB™ port, thereby providing a rigid connection between the peripheral and the laptop which physically supports the peripheral. However, such a rigid connection may prevent easy movement of the peripheral, which may be required for example to orient the network adapter antenna in a desired manner, for example to improve signal quality or reduce an amount of radiation directed toward a user.

Therefore there is a need for a computer port interface that is not subject to the above limitations.

Swivelling mechanical couplings are well known in the art. Generally, a swivelling mechanical coupling or simply a swivel comprises two mating portions, rotatable with respect to each other about a common axis. For example, U.S. Pat. Nos. 4,037,978, 5,484,220, 5,529,421, 5,685,661, 5,772,350 and 5,839,846, and United States Patent Application Publication No. 2009/0208274 each disclose examples of swivels.

However, a swivel mechanism on its own does not immediately or straightforwardly lead to a computer port interface.

This background information is provided for the purpose of making known information believed by the applicant to be of possible relevance to the present invention. No admission is necessarily intended, nor should be construed, that any of the preceding information constitutes prior art against the present invention.

SUMMARY OF THE INVENTION

An object of the present invention is to provide a computer port interface having a compound swivel. In accordance with an aspect of the present invention, there is provided a computer port interface apparatus comprising: a computer port connector portion configured for mated coupling with a computer port; a compound swivel portion comprising: a first swivel member, the computer port connector portion extending from the first swivel member; a second swivel member in swivelling engagement with the first swivel member; a first swivel stop assembly operatively coupled to the first and second swivel members, the first swivel stop assembly configured to limit relative rotation of the first and second swivel members to a first range; a third swivel member in swivelling engagement with the second swivel member; and a second swivel stop assembly operatively coupled to the second and third swivel members, the second swivel stop assembly configured to limit relative rotation of the second and third swivel members to a second range; and a peripheral portion extending from the third swivel member, the peripheral portion operatively coupled to the computer port connector portion for interface to the computer port.

In accordance with another aspect of the present invention, there is provided an apparatus for connection between a first electronic device and a second electronic device, the apparatus comprising a compound swivel portion comprising three or more stacked swivel members in swivelling engagement within a predetermined limited rotational range, the compound swivel portion operatively coupled at a first end to a connector portion and at a second end, opposite the first end, to a peripheral portion, the connector portion configured for mated coupling with the first electronic device, the peripheral portion configured for coupling with the second electronic device.

BRIEF DESCRIPTION OF THE FIGURES

These and other features of the invention will become more apparent in the following detailed description in which reference is made to the appended drawings.

DETAILED DESCRIPTION OF THE INVENTION

Definitions

Figure 1A:
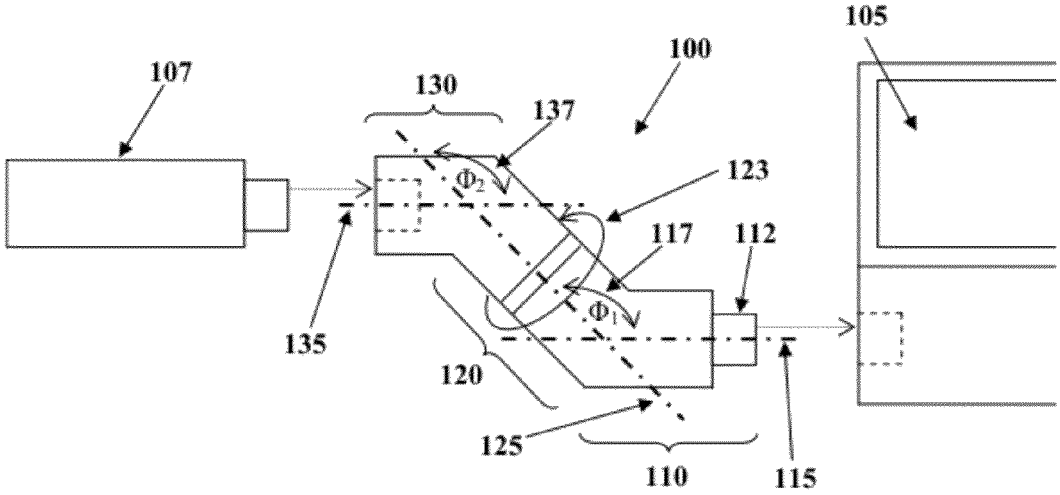
FIGS. 1A and 1B illustrate a side view of a computer port interface apparatus in two different configurations, in accordance with one embodiment of the present invention.

As used herein, the term "about" refers to a +/−10% variation from the nominal value. It is to be understood that such a variation is always included in a given value provided herein, whether or not it is specifically referred to.

Unless defined otherwise, all technical and scientific terms used herein have the same meaning as commonly understood by one of ordinary skill in the art to which this invention belongs.

An aspect of the present invention provides for a computer port interface apparatus comprising: a computer port connector portion, a compound swivel portion, and a peripheral portion. The computer port connector portion is configured for mated coupling with a computer port. For example the computer port connector portion may include a male USB™ type-A connector or other connector. The compound swivel portion includes: a first swivel member, a second swivel member in swivelling engagement with the first swivel member, and a third swivel member in swivelling engagement with the second swivel member. The first swivel member, second swivel member, and third swivel member are thus stacked and in swivelling engagement. The compound swivel portion further includes: a first swivel stop assembly operatively coupled to the first and second swivel members, the first swivel stop assembly configured to limit relative rotation of the first and second swivel members to a first range. The compound swivel portion further includes: a second swivel stop assembly operatively coupled to the second and third swivel members, the second swivel stop assembly configured to limit relative rotation of the second and third swivel members to a second range. One or both of the first and second swivel stop assemblies may be rigidly attached to or integrally formed with one or more swivel members. The computer port connector portion extends from the first swivel portion, for example being integrally formed or rigidly connected thereto. The peripheral portion extends from the third swivel member, for example being integrally formed or rigidly connected thereto. The peripheral portion is operatively coupled to the computer port connector portion for interface to the computer port. For example, the peripheral portion and computer port portion may each comprise one or more conductors, such as conductors carrying power and/or signals, and a signal pathway may couple conductors of the peripheral portion to conductors of the computer port portion. The signal pathway may pass through the compound swivel portion.

An aspect of the present invention provides for an apparatus for connection between a first electronic device, such as a computer or laptop computer, and a second electronic device, such as a peripheral electronic device. The apparatus comprises a compound swivel portion comprising three or more stacked swivel members in swivelling engagement within a predetermined limited rotational range, for example by an appropriate arrangement of swivel stop members, springs, magnets, or the like. The compound swivel portion is operatively coupled at a first end to a connector portion, such as a USB™ or other connector extending from the compound swivel portion. The compound swivel portion is connected at a second end, opposite the first end, to a peripheral portion, such as an integrated peripheral electronic device or USB™ or other connector extending from the compound swivel portion. The connector portion is configured for mated coupling with the first electronic device, and the peripheral portion configured for coupling with the second electronic device.

The present invention provides for a computer port interface apparatus. Embodiments of the computer port interface apparatus may be configured to interface with a standard or proprietary computer port, such as a USB™ port or other port as described herein. In some embodiments, the computer port interface apparatus may comprise a device such as a peripheral electronic device configured to interface via the provided computer port when plugged into a computing device. In some embodiments, the computer port interface apparatus may comprise another computer port for interfacing with a separate device such as a peripheral electronic device.

Figure 1B:
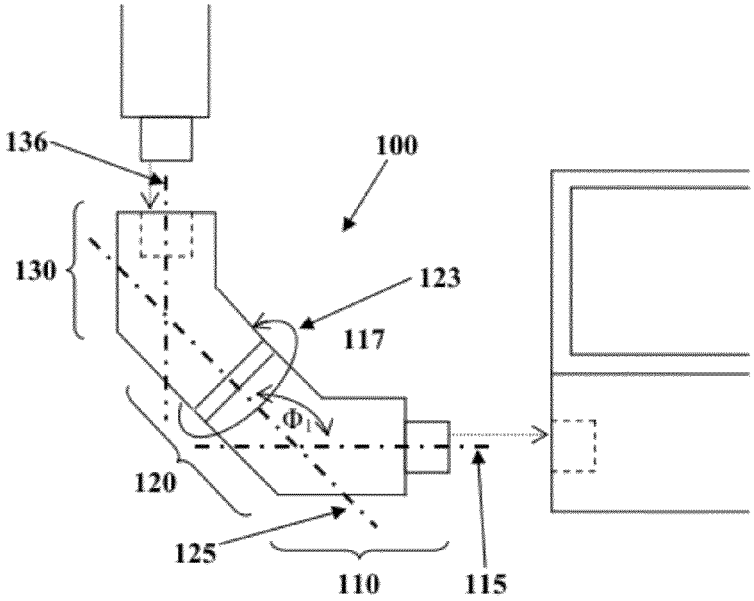

FIGS. 1A and 1B illustrate side views of computer port interface apparatus 100 in accordance with an embodiment of the present invention. FIG. 1A illustrates the computer port interface apparatus 100 in a first swivel position. The apparatus 100 includes a computer port connector portion 110 for mating connection to a host computing device 105, such as a laptop. For example, the computer port connector portion 110 may include a male USB™ connector 112. The apparatus 100 further includes a swivel portion 120 coupled to the computer port connector portion 110. The connection may be a rigid connection, or the computer port connector portion 110 or housing thereof may be integrally formed with part of the swivel portion 120 or housing thereof. As illustrated, the swivel portion 120 swivels 123 about a swivel axis 125, and the computer port connector portion 110 extends from the swivel portion along a main axis 115. The axes 115 and 125 may intersect at an oblique or non-oblique angle $\phi_1$ 117. As illustrated, angle $\phi_1$ 117 is about 135°, although other angles are also contemplated and may lead to different configurations of the present invention.

FIG. 1A further illustrates a peripheral portion 130 of the apparatus 100 for mating connection to a peripheral device 107, such as a wireless network interface. For example, the peripheral portion 130 may include a female USB™ connector of the same type as the connector of computer port connector portion 110. The peripheral portion 130 is coupled to the swivel portion 120. The connection may be a rigid connection, or the peripheral portion 130 or housing thereof may be integrally formed with part of the swivel portion 120 or housing thereof. As illustrated, the peripheral portion 130 extends from the swivel portion along a main axis 135, generally parallel to main axis 115 for the present swivel position. The axes 125 and 135 may intersect at an oblique or non-oblique angle $\phi_2$ 137. As illustrated, angle $\phi_2$ 137 is about 135°, although other angles are also contemplated and may lead to different configurations of the present invention. Use of a 135° angle $\phi_2$ 137 facilitates about a 90° reorientation of the main axis 135, 136 when the swivel is rotated by about 180°, as illustrated in FIGS. 1A and 1B. Other values of angle $\phi_2$ 137 may result in other angular reorientations, which may be desirably implemented in embodiments of the invention.

FIG. 1B illustrates the computer port interface apparatus 100 in a second swivel position, corresponding to rotation 123 of the compound swivel about the swivel axis 125 by about 180° relative to the first swivel position. This results in the main axis 136 of the peripheral portion 130 being generally perpendicular to main axis 115 of the computer port connector portion 110, which corresponds to the about 90° reorientation of the peripheral portion main axis 135 of FIG. 1A when the swivel is rotated by about 180°. As would be readily understood by a worker skilled in the art, other configurations may be provided by rotating the swivel to other intermediate or further angles.

Figure 2:
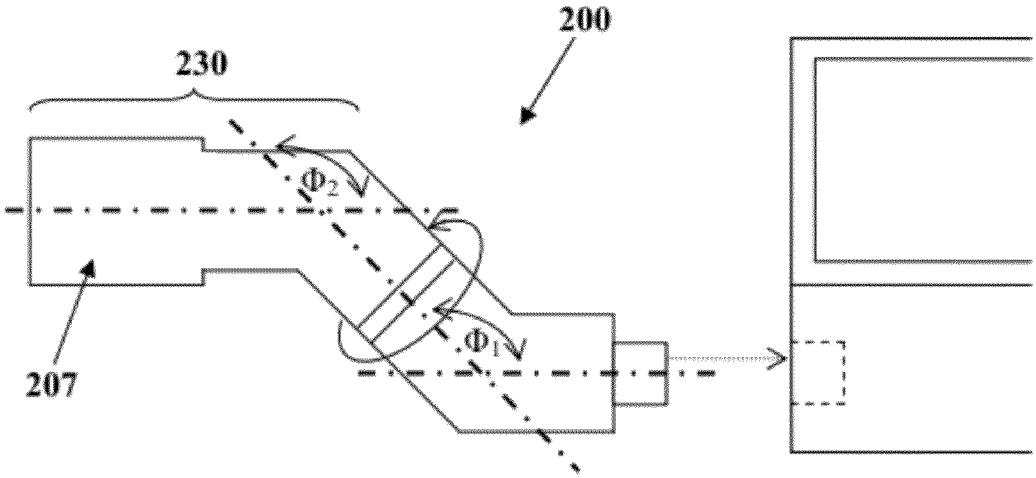
FIG. 2 illustrates a side view of a computer port interface apparatus in accordance with another embodiment of the present invention.

FIG. 2 illustrates a side view of a computer port interface apparatus 200 in accordance with another embodiment of the present invention. The apparatus 200 is generally similar to the apparatus 100 illustrated in FIGS. 1A and 1B, except that the peripheral portion 230 includes an integral peripheral device 207 instead of an interface for connection to a separate peripheral device as in the apparatus 100. The integral peripheral device 207 may be a wireless network adapter or modem, for example.

In embodiments of the invention, signal connections included in the computer port connector portion are operatively coupled to corresponding signal connections, wires, traces, or the like, included in the peripheral portion. For example, one or more bundled or unbundled wires, passing through the swivel portion, may be configured to provide such operative coupling. As another example, signal connections may comprise rigid signal traces, for example provided as a printed circuit, and electrical contact assemblies operatively coupled thereto, such as comprising one or more wire brushes contacting conductive surfaces, thereby maintaining electrical continuity of the signal connections during swivelling motion.

The compound swivel portion provides for reconfigurability of the apparatus by rotation of the swivel portion about a swivel axis. Use of a swivel may also allow the apparatus to be substantially rigid in other directions, thereby providing structural support for holding the peripheral portion at a desired location. In some embodiments, the peripheral portion may extend outward from the swivel portion along a main axis of the peripheral portion. The peripheral portion main axis and swivel axis may be configured to intersect at about 135° (or 45°, depending on how the angle of intersection is measured). This configuration facilitates reorientation of the peripheral portion between a first position and a second position by operating the swivel to swivel about 180°. Such reorientation results in the peripheral portion being oriented, in the second position, such that the main axis thereof is offset by about 90° from the peripheral portion main axis of the first position. In some embodiments, a continuum of intermediate orientations of the peripheral portion may also be provided, as well as positions provided by rotating the swivel through rotations beyond 180°, for example up to a predetermined limit.

Reorientation may be used, for example, when the computer port connector portion is fixed, for example connected to a laptop or other computer device, and the peripheral portion is associated with an orientation-sensitive peripheral device. The peripheral portion is then reorientably supported against the computer device by the present invention. For example, for a wireless network interface peripheral or other peripheral device having an antenna, the present invention may facilitate reorientation of the antenna for improving wireless connectivity, reducing undesired radiation absorbed by a user, or the like. Other orientation-sensitive peripheral devices may include cameras, directional microphones, peripherals comprising infrared or other line-of-sight communication portions, speakers, fans, and the like.

In embodiments of the present invention, the compound swivel includes one or more swivel stop assemblies, configured to limit relative swivel rotation. This may facilitate improved usability by providing for natural swivel rest positions where the swivel stops assemblies engage to limit rotation. Additionally, limiting relative swivel rotation by use of swivel stops may protect components within the swivel, such as wires coupling the computer port connection portion to the peripheral portion. Without swivel stops, such wires or other signal path means may be subjected to stress and damage due to twisting, should the swivel be rotated beyond a predetermined angular threshold. In embodiments of the invention, the compound swivel facilitates the use of swivel stops to impede rotation beyond a predetermined range, while enabling such rotation range to be equal to or greater than 360°. Rotation ranges of less than 360° are also possible in embodiments of the present invention.

Computer Port Connector Portion

The computer port interface apparatus includes a computer port connector portion. The computer port connector portion is configured for mated coupling with a computer port. For example the computer port connector portion may include a male USB™ type-A connector or other connector. More generally, the computer port connector portion may include a male or female portion of a port connector such as a serial, parallel, USB™ (type A, type B, standard, mini, micro, or the like), Firewire™, PS/2, RJ-485, Centronics™ port, parallel port, IEEE 1284 port, DB-9, DB-25, audio port, video port, VGA port, DVI port, SCSI port, Ethernet port, mini-DIN port, or other standard, custom or proprietary computer port providing power, data, or a combination thereof, or the like.

The computer port connector portion extends from the first swivel portion along a main axis of the computer port connector portion. For example the two portions may be integrally formed with or rigidly connected with each other. In some embodiments, a single housing component is common between a portion of the computer port connector portion and the first swivel portion. The single housing component may include a bend, such as a 135° bend, which, in embodiments, may be coincident with a boundary between the computer port connector portion and the swivel portion.

In embodiments of the invention, the computer port connector portion comprises one or more conductive contacts for mating with corresponding conductive contacts of a computer port. For example, USB™ connectors typically comprise four conductive contacts: two for providing a differential serial signal connection, one for providing power, and one for providing ground. The conductive contacts may each be electrically connected to corresponding conductors which extend into the computer port connector portion, and from there are operatively coupled to corresponding conductors of the peripheral portion. Operative coupling may be provided by one or more conductors such as flexible wires passing through the compound swivel portion, or other means which allow for substantially uninterrupted coupling when the swivel portion is oriented in two or more different swivel positions.

Compound Swivel Portion

The computer port interface apparatus includes a compound swivel portion. The compound swivel portion facilitates flexibility of orientation of the peripheral portion of the apparatus relative to the computer port connector portion about a swivel axis, while also providing rigid structure for resisting twisting in other directions and for resisting other deformation of the apparatus. This allows the apparatus to act as all or part of a reconfigurable support structure for an integral or attached peripheral device, for example.

The compound swivel portion includes: a first swivel member, a second swivel member in swivelling engagement with the first swivel member, and a third swivel member in swivelling engagement with the second swivel member. The first and third swivel members are attached or integrally formed with the computer port connector portion and peripheral portion, respectively. The second swivel member may be a washer-like or cam-ring-like body between the first and third swivel members. The first and second swivel members form a first swivel, while the second and third swivel members form a second swivel.

Each swivel member comprises a portion configured for rotatable mating engagement with its one or more adjacent swivel members. In some embodiments, each swivel member may be generally cylindrically, hemispherically, frusto-conically or otherwise shaped, for example with parallel or non-parallel faces, faces perpendicular or oblique to the swivel axis, or the like. Bearing assemblies, circular tongue and groove assemblies, washers, spacers, springs, generally flat surfaces having a desired friction coefficient, or a combination thereof, or other means may be used to provide rotatable mating engagement between swivel members, as would be readily understood by a worker skilled in the art.

The compound swivel portion further includes: a first swivel stop assembly operatively coupled to the first and second swivel members, the first swivel stop assembly configured to limit relative rotation of the first and second swivel members to a first range. The compound swivel portion further includes: a second swivel stop assembly operatively coupled to the second and third swivel members, the second swivel stop assembly configured to limit relative rotation of the second and third swivel members to a second range. One or both of the first and second swivel stop assemblies may be rigidly attached to or integrally formed with one or more swivel members.

In some embodiments, a swivel stop assembly comprises a pair of bodies, each rigidly attached to or integrally formed with a different adjacent swivel member. Each of said bodies projects into an aperture formed between the adjacent swivel members. The bodies of the swivel stop assembly are configured to allow substantially unimpeded relative rotation of the adjacent swivel members within a predetermined range, but are positioned such that the bodies engage or abut each other at limits of said range, thereby impeding further relative rotation beyond the predetermined range. Swivel stop bodies may be configured to engage each other when the associated swivel members are relatively swivelled to one or more limit positions, thereby limiting relative rotation of the associated swivel members. In embodiments of the present invention, two limit positions are provided, for limiting relative rotation in both the clockwise and counter clockwise directions.

In some embodiments, for first and second swivel stop bodies projecting generally perpendicularly from the swivel members, the range of unimpeded angular rotation $\theta_{free}$ can be approximately calculated as:

$$\theta_{free}=(360°-\theta_A-\theta_B), \quad (1)$$

where $\theta_A$ and $\theta_B$ are the angles occupied by the first and second swivel stop bodies, respectively. Since the swivel stop bodies typically occupy finite volume, $\theta_A$ and $\theta_B$ are generally strictly nonzero. Additionally, $\theta_{free}$ is generally strictly nonzero. In one embodiment $\theta_A=\theta_B=90°$.

Figure 3:
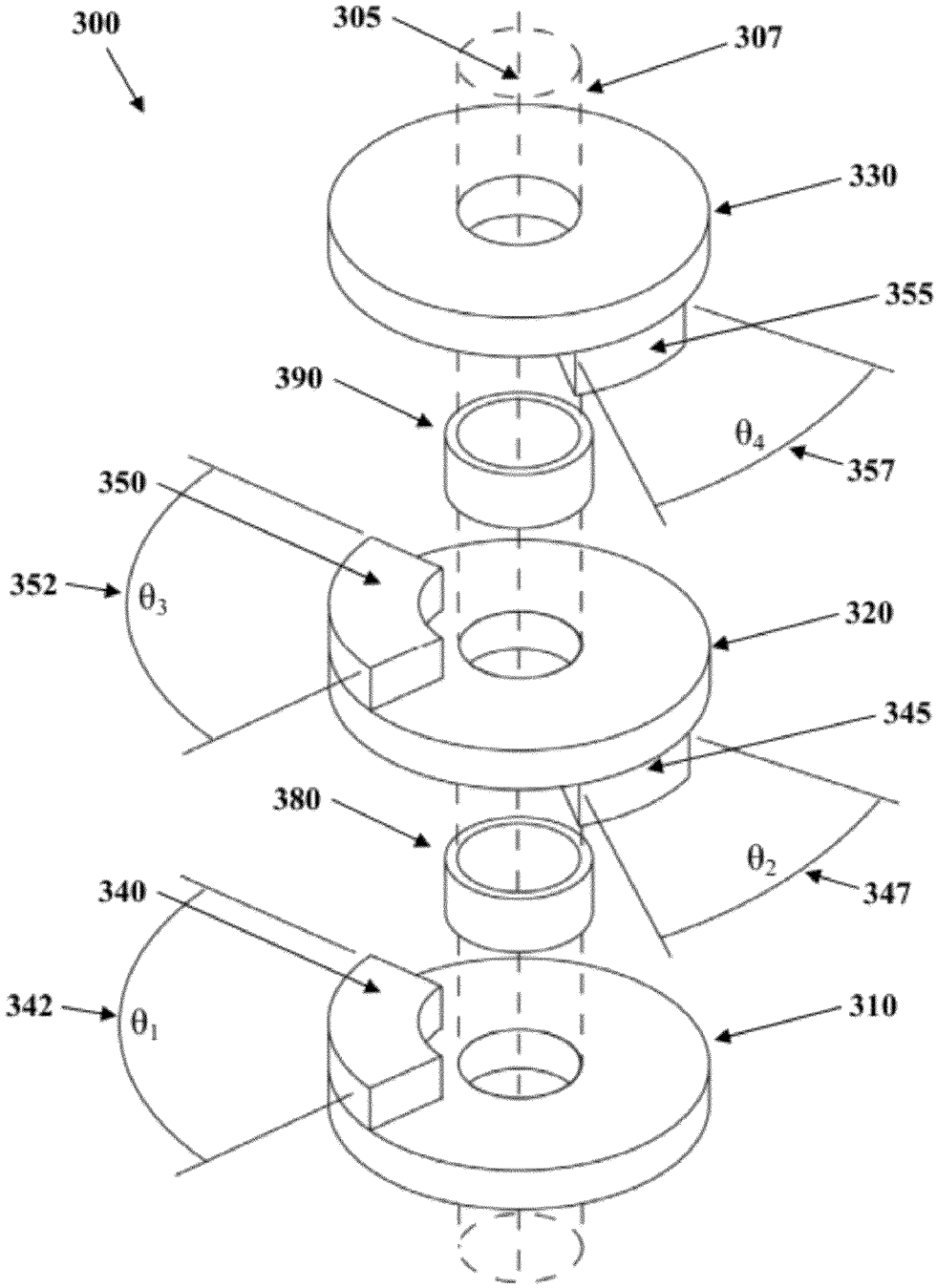
FIG. 3 illustrates an exploded perspective view of a compound swivel in accordance with an embodiment of the present invention.

FIG. 3 illustrates a simplified exploded perspective view of a compound swivel portion 300 in accordance with an embodiment of the present invention. This view has been simplified so as to illustrate key aspects of the swivel operation; components for providing cohesion to the swivel assembly, for allowing ease of swivel action, and the like, have been omitted. Providing of such components would be readily understood by a worker skilled in the art. The compound swivel portion 300 includes a first swivel member 310 adjacent to a second swivel member 320, which is in turn adjacent to a third swivel member 330. Each swivel member 310, 320, 330 comprises a generally cylindrical body configured to rotate about a common swivel axis 305 relative to at least another swivel member 310, 320, 330.

FIG. 3 also illustrates swivel stop bodies 340 and 345 of a first swivel stop assembly, coupled to swivel members 310 and 320, respectively, for example by rigid connection or by being integrally formed therewith. The swivel stop bodies 340 and 345, upon assembly, extend into an aperture defined between swivel members 310 and 320 and are located within the aperture such that the swivel stop bodies 340 and 345 engage or abut each other laterally at two relative angular positions of swivel members 310 and 320, that is when swivel member 310 is rotated clockwise or counter clockwise relative to swivel member 320.

In some embodiments, operation of the first swivel stop assembly can be described more specifically as follows: angles $\theta_1$ 342 and $\theta_2$ 347 are defined as the angles subtended by swivel stop bodies 340 and 345, respectively. These angles are configured such that $\theta_1+\theta_2<360°$, to allow relative rotation of swivel members 310 and 320 by up to $\theta_{free}$ degrees, as defined by Equation (1). Swivel stop bodies 340 and 345 divide the aperture between swivel members 310 and 320 into two parts, which are subtended by angles $\theta_{free,A}$ and $\theta_{free,B}$ (not shown), such that $\theta_{free}=\theta_{free,A}+\theta_{free,B}$. While $\theta_{free,A}$ and $\theta_{free,B}$ are variable by relative rotation of swivel members 310 and 320, $\theta_{free}$ is constant. Furthermore, both $\theta_{free,A}$ and $\theta_{free,B}$ are constrained by the system to be greater than or equal to zero. Thus, either condition $\theta_{free,A}=0$ or $\theta_{free,B}=0$ corresponds to contact or abutment between the left edge of one of swivel stop bodies 340 or 345 with the right edge of the other, which impedes further relative rotation of swivel members 310 and 320.

FIG. 3 also illustrates swivel stop bodies 350 and 355 of a second swivel stop assembly, coupled to swivel members 320 and 330, respectively, for example by rigid connection or by being integrally formed therewith. The second swivel stop assembly is formed and may operate analogously to the first swivel stop assembly, although angles $\theta_3$ 352 and $\theta_4$ 357 need not be equal to angles $\theta_1$ 342 and $\theta_2$ 347, respectively.

FIG. 3 also illustrates spacers 380 and 390, placed between adjacent swivel members 310 and 320, and 320 and 330, respectively. The spacers 380 and 390 facilitate definition of apertures between adjacent swivel members. The spacers 380, 390 may additionally facilitate relative rotation of adjacent swivel members 310, 320, 330. For example the spacers 380, 390 may comprise bearing assemblies, or contact the swivel members at a desired coefficient of friction. The spacers 380, 390 may alternatively be integrally formed with one or more swivel members 310, 320, 330. The spacers 380, 390 may be rigid or resilient; for example one or more spacers may comprise a spring. Spacers 380, 390 may also include or be coupled to hardware for providing cohesion or structure to the compound swivel portion 300 or the apparatus in general.

FIG. 3 also illustrates a generally cylindrical channel 307, which is defined by apertures in the swivel members 310, 320, 330 and spacers 380, 390. A signal pathway, such as comprising coiled, uncoiled, bundled, or unbundled wires, (not shown) may be provided passing through the channel 307 to operatively couple the computer port connector portion and the peripheral portion. The channel 307 may communicate with cavities within the computer port connector portions and peripheral portions for this purpose.

Figure 4:
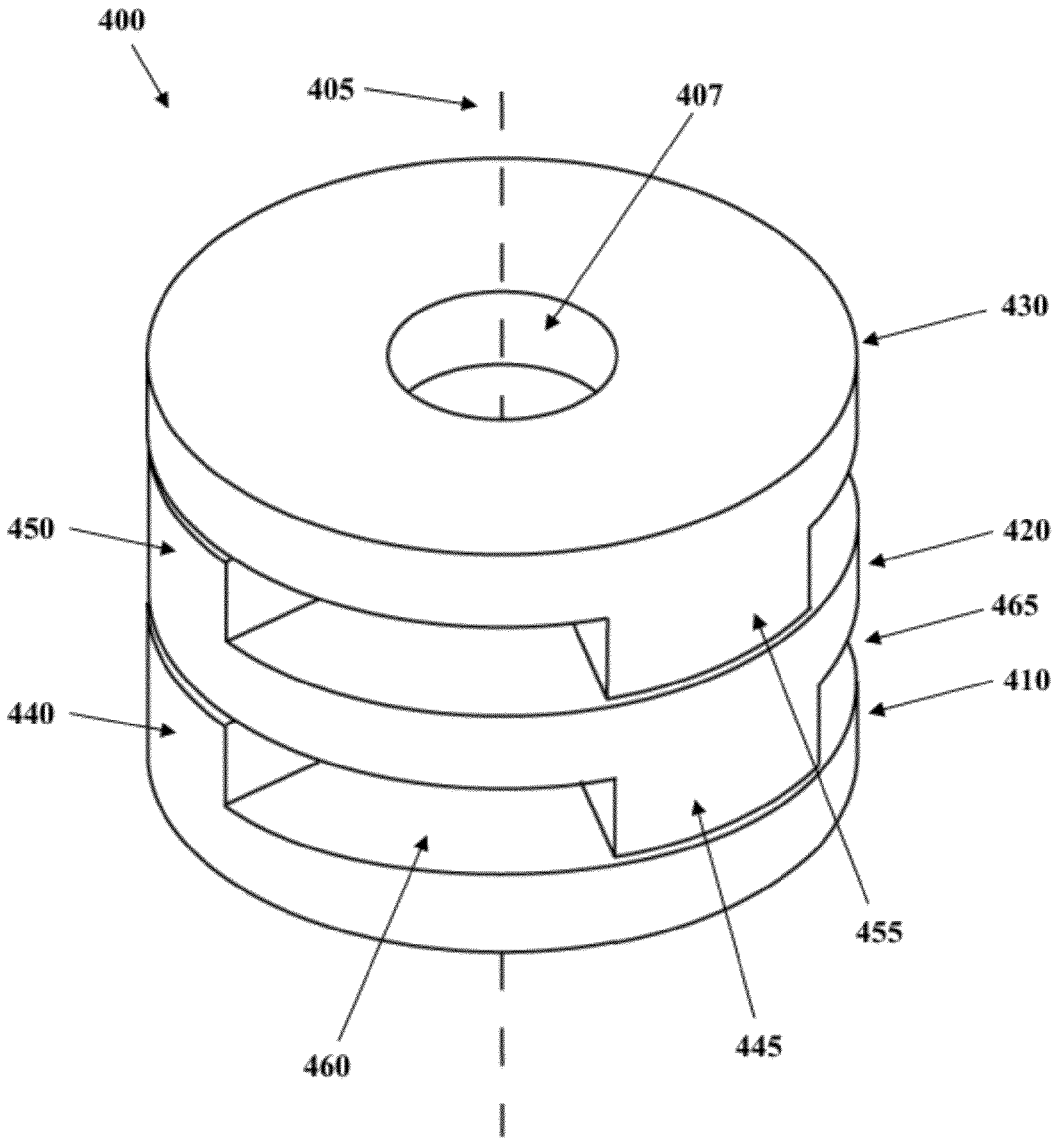
FIG. 4 illustrates a perspective view of a compound swivel in accordance with an embodiment of the present invention.

FIG. 4 illustrates a simplified perspective view of an assembled compound swivel 400 in accordance with an embodiment of the present invention. As illustrated, the compound swivel 400 comprises first, second and third swivel members 410, 420, and 430, respectively, each configured to rotate about a common swivel axis 405. Also illustrated is a channel 407 for accommodating a signal pathway for coupling the computer port connector portion and the peripheral portion. Also illustrated are swivel stop bodies 440 and 445 of a first swivel stop assembly, and swivel stop bodies 450 and 455 of a second swivel stop assembly. In embodiments, the swivel 400 operates substantially the same as the swivel 300 as described herein.

Apertures between the swivel members and swivel stop bodies are more clearly seen in FIG. 4. For example, apertures 460 and 465 between the first and second swivel members 410 and 420 are at least partially visible. The angles subtended by these apertures change as first and second swivel members 410 and 420 relatively rotate, but are constrained to be greater than zero by contact of the swivel stop bodies 440 and 445.

In some embodiments, a swivel stop assembly may comprise one or more swivel stop bodies protruding from a plane of a swivel member into the aperture. That is, a swivel stop body may protrude generally directly into the aperture between swivel members, for example as illustrated in FIGS. 3 and 4. In some embodiments, a swivel stop body may protrude into the aperture in another manner, for example by providing different topologies of the swivel members, swivel stop members, or both.

Figure 5A:
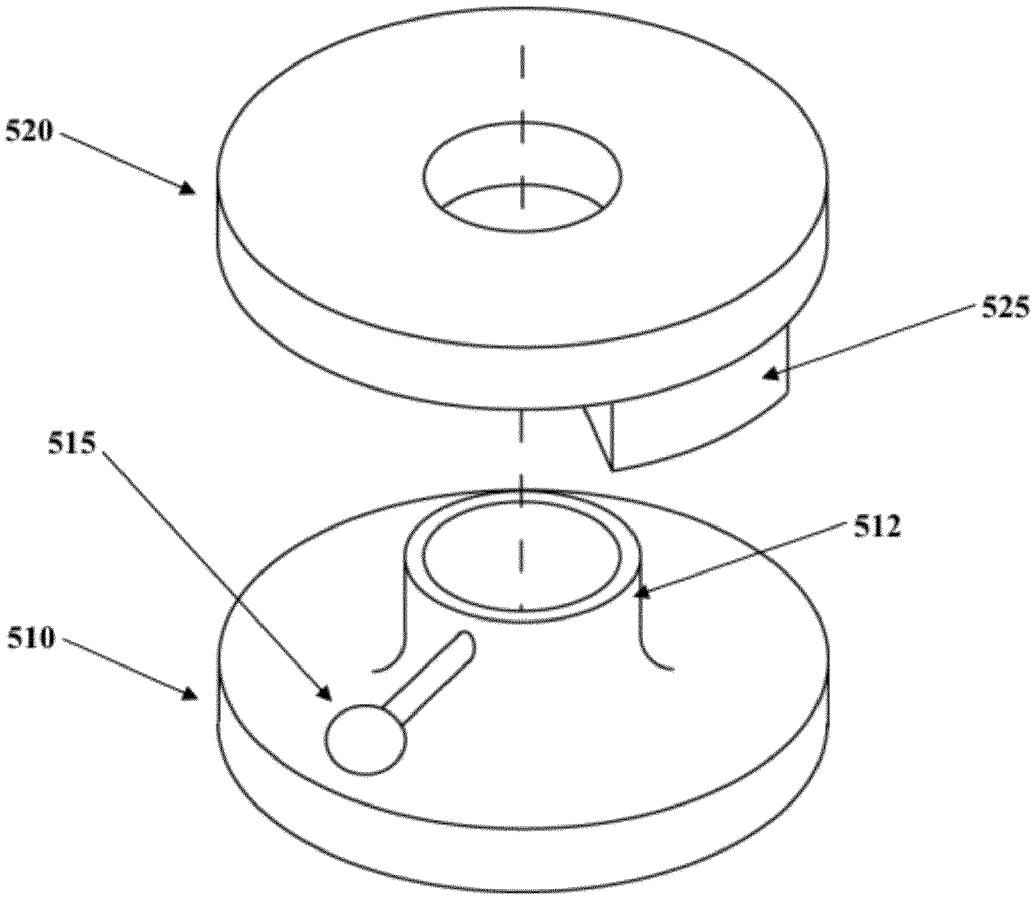
FIGS. 5A and 5B illustrate perspective views of swivel portions in accordance with embodiments of the present invention.
Figure 5B:
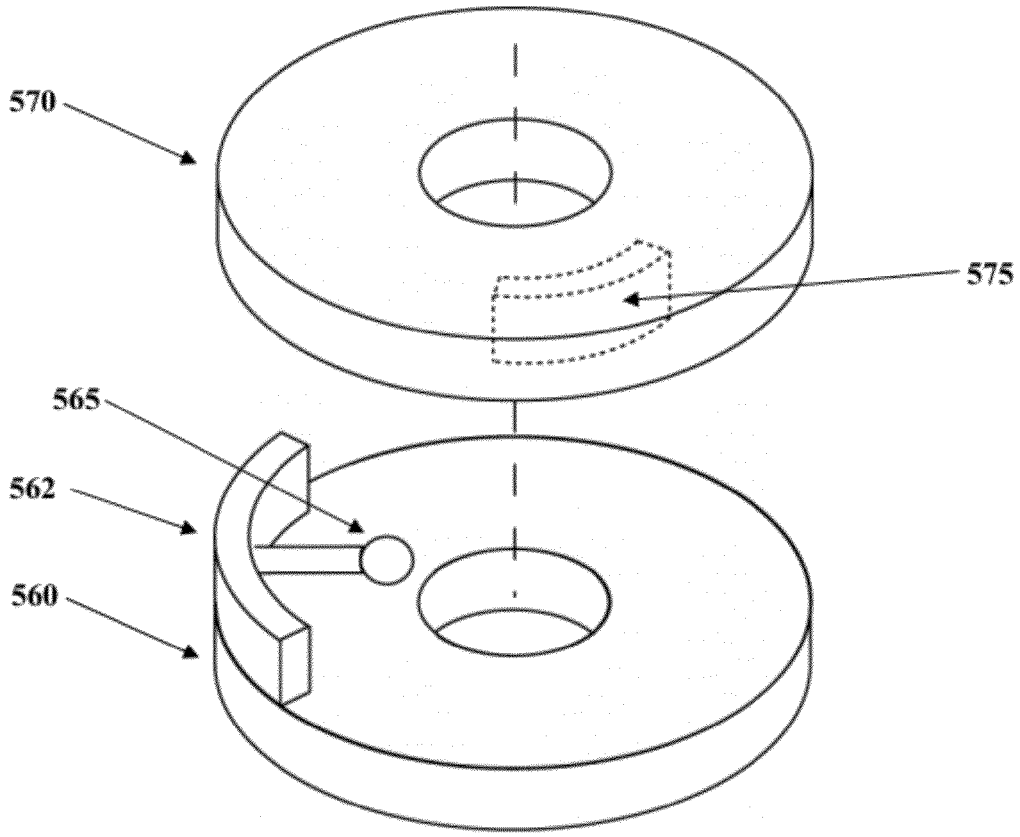

FIGS. 5A and 5B illustrate simplified exploded views of additional potential swivel stop assemblies coupled to a pair of adjacent swivel members in accordance with embodiments of the present invention. FIG. 5A illustrates a swivel stop body 515 coupled to a flange 512 extending from swivel member 510, and a corresponding swivel stop body 525 coupled to or integrally formed with adjacent swivel member 520 and extending therefrom. The swivel stop bodies 515 and 525 are configured to engage each other upon assembly to limit relative rotation of the swivel members 510 and 520. FIG. 5B illustrates a swivel stop body 565 coupled to a flange or protrusion 562 extending from swivel member 560, and a corresponding swivel stop body 575 coupled to or integrally formed with adjacent swivel member 570 and extending from the bottom thereof. The swivel stop bodies 565 and 575 are configured to engage each other upon assembly to limit relative rotation of the swivel members 560 and 570.

Figure 6A:
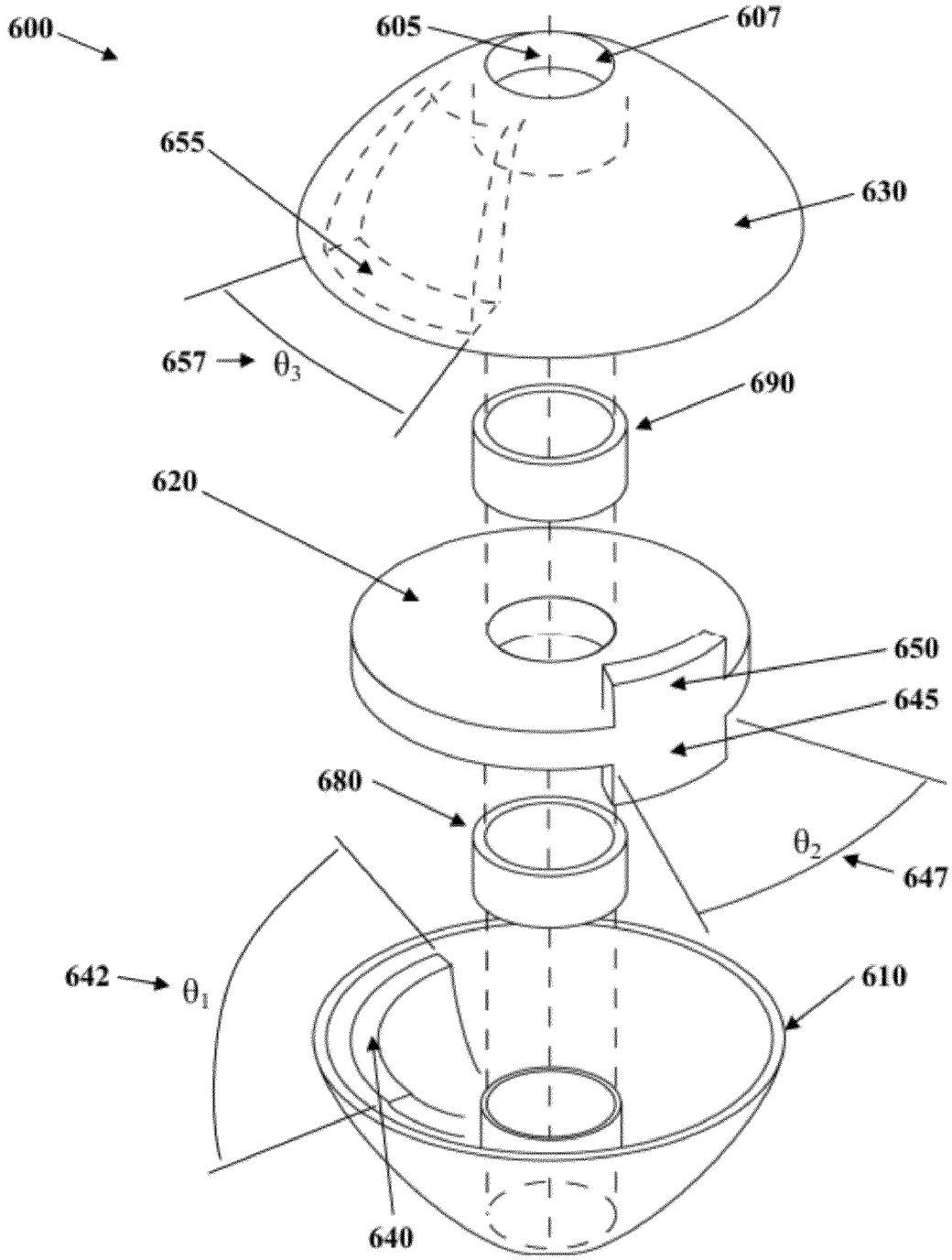
FIG. 6A illustrates an exploded perspective view of a compound swivel in accordance with an embodiment of the present invention.

FIG. 6A illustrates a simplified exploded perspective view of a compound swivel portion 600 in accordance with an embodiment of the present invention. This figure has been again simplified so as to illustrate key aspects of the swivel operation; components for providing cohesion to the swivel assembly, for allowing ease of swivel action, and the like, have been omitted. Providing of such components would be readily understood by a worker skilled in the art. The compound swivel portion 600 includes a first swivel member 610 adjacent to a second swivel member 620, which is in turn adjacent to a third swivel member 630. Swivel members 610 and 630 each comprise a generally hemispherical body defining an aperture therein. Swivel member 620 comprises a generally cylindrical body. In some embodiments, swivel member 620 may be completely enclosed by swivel members 610 and 630 upon assembly. Each swivel member 610, 620, 630 is configured to rotate about a common swivel axis 605 relative to at least another swivel member 610, 620, 630.

FIG. 6A also illustrates swivel stop bodies 640 and 645 of a first swivel stop assembly, coupled to swivel members 610 and 620, respectively, for example by rigid connection or by being integrally formed therewith. The swivel stop bodies 640 and 645, upon assembly, extend into an aperture defined between swivel members 610 and 620 and are located within the aperture such that the swivel stop bodies 640 and 645 engage or abut each other laterally at two relative angular positions of swivel members 610 and 620, that is when swivel member 610 is rotated clockwise or counter clockwise relative to swivel member 620.

In some embodiments, operation of the first swivel stop assembly can be described more specifically as follows: angles $\theta_1$ 642 and $\theta_2$ 647 are defined as the angles subtended by swivel stop bodies 640 and 645, respectively. These angles are configured such that $\theta_1+\theta_2<360°$, to allow relative rotation of swivel members 610 and 620 by up to $\theta_{free}$ degrees, as defined by Equation (1). Swivel stop bodies 640 and 645 divide the aperture between swivel members 610 and 620 into two parts, which are subtended by angles $\theta_{free,A}$ and $\theta_{free,B}$ (not shown), such that $\theta_{free}=\theta_{free,A}+\theta_{free,B}$. While $\theta_{free,A}$ and $\theta_{free,B}$ are variable by relative rotation of swivel members 610 and 620, $\theta_{free}$ is constant. Furthermore, both $\theta_{free,A}$ and $\theta_{free,B}$ are constrained by the system to be greater than or equal to zero. Thus, either condition $\theta_{free,A}=0$ or $\theta_{free,B}=0$ corresponds to contact or abutment between the left edge of one of swivel stop bodies 640 or 645 with the right edge of the other, which impedes further relative rotation of swivel members 610 and 620.

FIG. 6A also illustrates swivel stop bodies 650 and 655 of a second swivel stop assembly, coupled to swivel members 620 and 630, respectively, for example by rigid connection or by being integrally formed therewith. The second swivel stop assembly is formed and may operate analogously to the first swivel stop assembly, although angle $\theta_3$ 657 may be different from angle $\theta_1$ 642. Furthermore, swivel stop body 650 may be subtended by a different angle than swivel stop body 645.

In some embodiments, each of angles $\theta_1$ 642, $\theta_2$ 647, and $\theta_3$ 657 are equal to about 90°, thereby allowing about 180° of relative rotation of adjacent swivel members, and a total of about 360° of relative rotation between the first and third swivel members.

FIG. 6A also illustrates spacers 680 and 690, placed between adjacent swivel members 610 and 620, and 620 and 630, respectively. The spacers 680 and 690 facilitate maintenance of apertures between adjacent swivel members. The spacers 680, 690 may additionally facilitate relative rotation of adjacent swivel members 610, 620, 630. For example the spacers 680, 690 may comprise bearing assemblies, or contact the swivel members at a desired coefficient of friction. The spacers 680, 690 may alternatively be integrally formed with one or more swivel members 610, 620, 630. The spacers 680, 690 may be rigid or resilient; for example one or more spacers may comprise a spring. Spacers 680, 690 may also include or be coupled to hardware for providing cohesion or structure to the compound swivel portion 600 or the apparatus in general.

FIG. 6A also illustrates a generally cylindrical channel 607, which is defined by apertures in the swivel members 610, 620, 630 and spacers 680, 690. A signal pathway, such as comprising coiled, uncoiled, bundled, or unbundled wires, (not shown) may be provided passing through the channel 607 to operatively couple the computer port connector portion and the peripheral portion.

Figure 6B:
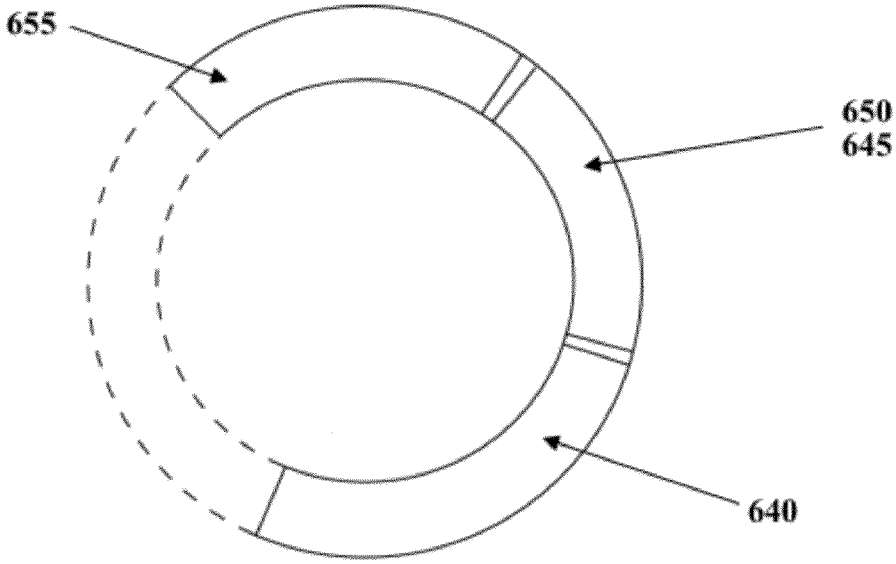
FIGS. 6B and 6C illustrate schematic views, along the swivel axis, showing possible relative positions of the swivel stop bodies illustrated in FIG. 6A.
Figure 6C:
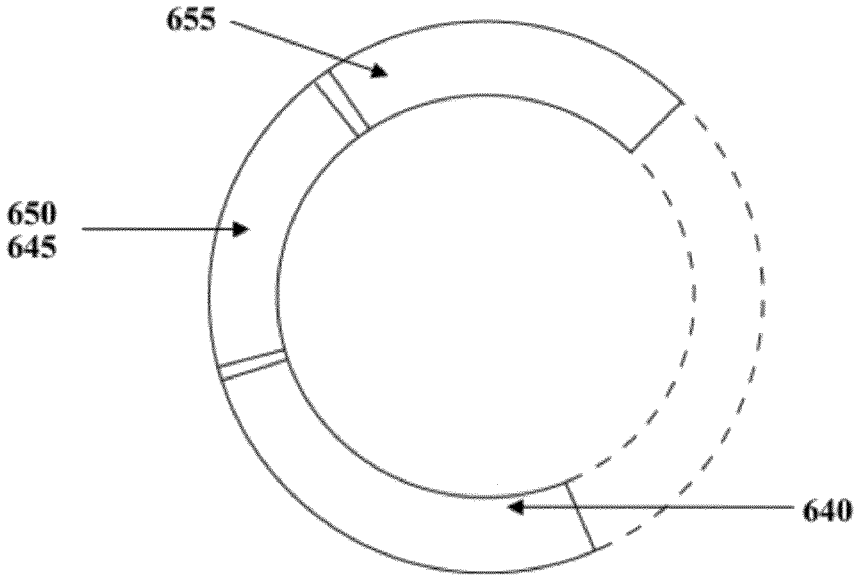

FIGS. 6B and 6C illustrate schematic views along the swivel axis, showing relative positions of swivel stop bodies 640, 645, 650, 655 in two end positions corresponding to maximum rotation of the first swivel member 610 relative to the third swivel member 630, at the points where both first and second swivel stop assemblies are engaged to impede further relative rotation in a direction. In FIG. 6B, the third swivel member has been rotated clockwise relative to the first swivel member, to the point where swivel stop bodies 640 and 645 of the first swivel stop assembly are engaged, and swivel stop bodies 650 and 655 of the second swivel stop assembly are engaged. In FIG. 6C, the third swivel member has been rotated counter clockwise relative to the first swivel member, to the point where swivel stop bodies 640 and 645 of the first swivel stop assembly are engaged, and swivel stop bodies 650 and 655 of the second swivel stop assembly are engaged.

It will be understood that the compound swivel or portions thereof may be provided in various other ways. For example, an interior portion of one or more of the swivel stop bodies 340, 345, 350, 355, 640, 645, 650, 655, may be removed without affecting operation thereof, thereby providing two bodies in place of one. In some embodiments, plural swivel stop bodies may be rigidly attached or integrally formed with the same swivel member and associated with the same swivel assembly. As another example, a swivel stop assembly may comprise a swivel stop body projecting from a first swivel member toward a second swivel member, and being received within a groove of the second swivel member. The groove may narrow or include obstructions which impede motion of the swivel stop body beyond a predetermined angular range.

In some embodiments, an elastically deformable body such as a spring may be incorporated into a swivel stop mechanism to allow for some motion beyond the point of first engagement of the swivel stop mechanism. This configuration would allow for impedance of motion beyond a predetermined angular range to be applied gradually, such that some amount of motion beyond said range would be at least temporarily possible. In some embodiments, the elastically deformable body may be biased to return the swivel to a swivel stop position when the swivel is moved beyond said predetermined angular range. In some embodiments, a repelling pair of magnets may be used in place of or in addition to an elastically deformable body to form a gradually engaging swivel stop mechanism.

The compound swivel allows for extended range of motion over a single swivel with a single stop assembly. Generally, if each of the first and second swivels of the compound swivel operates independently, the total angular range of motion is about equal to the sum of the angular ranges of motion of the first and second swivels. Since a swivel stop assembly, according to some embodiments of the invention, allows for an angular range of motion of strictly less than 360°, embodiments of the present invention may utilize the compound swivel to obtain a total angular range of motion of about 360° or more. For example, two swivels and associated swivel stop assemblies such as described above may be used to provide total angular range of motion approaching about 720°. Three or more swivels and associated swivel stop assemblies may be used to provide even more total angular range of motion.

In embodiments of the present invention, a signal pathway may pass through the compound swivel portion. For example, the compound swivel portion may comprise a channel or aperture through which electrical signal connections of a signal pathway may be made between the computer port connector portion and the peripheral portion. As used herein, the signal pathway may comprise communication pathways, power pathways, ground pathways, or a combination thereof. For example, the channel may be an open-ended channel passing through the compound swivel portion and communicating with the computer port connector portion and the peripheral portion on either end. Conductors such as wires may pass through the channel and be connected on either end to conductors of the computer port connector portion and the peripheral portion to provide elements of the signal pathway. In some embodiments, two or more wires may be bundled together. In some embodiments, wires may be coiled so as to reduce the potential for damage due to swivelling within a predetermined range. In embodiments of the invention, the signal pathway is configured so as to be undamaged during normal operation, including swivelling within the range of motion limited by the swivel stop assemblies.

In some embodiments, the compound swivel may be configured to have one or more discrete rest positions, wherein the swivel angle tends to remain in a rest position once placed therein. Rest positions may also be attractive, such that the swivel is biased to fall into a nearby rest position if left in another angular position. For example, rest positions may coincide with swivel stop positions or with intermediate stop positions. Intermediate stop positions may be provided such that the swivel may be moved through the intermediate stop position by using a predetermined amount of force, such as may be applied by hand. Magnets, spring-loaded and/or frictionally engaging bumps and grooves, or the like, may be implemented to provide rest positions at desired angular positions of the compound swivel. For example, a first set of one or more magnets may be coupled to one swivel member and a second set of one or more magnets or metal may be coupled to another swivel member, the first set and the second set proximate and tending to attract each other, thereby biasing the swivel members toward a rotational rest position, the rest position substantially corresponding to the first set and the second set being as close as possible under the mechanical constraints of the swivel members.

In some embodiments, a detent mechanism, such as a ball detent or other detent mechanism, may be used for providing a predetermined number of rest positions or intermediate stop positions. For example, a ball detent may comprise a metal sphere, such as a ball bearing, positioned within a cylindrical bore of one swivel member, the sphere resting against a compressed spring which pushes the sphere toward a surface of a portion of another swivel member. The sphere may be configured such that it engages such a surface, the surface including indentations into which the sphere is configured to partially fit, thereby at least partially resisting swivelling motion. For example, when torque below a predetermined threshold is applied, the sphere, engaged in a groove, may stop swivelling from occurring, whereas when torque above the threshold is applied, the sphere may be caused to disengage from the groove, thereby allowing swivelling motion.

In some embodiments, the compound swivel portion may be configured to have a continuum of rest positions. For example, adjacent swivel members may each comprise surfaces which are configured to frictionally engage with each other, thereby impeding relative rotation over a continuum of angular positions. Such frictional surfaces may be pressed together, for example by springs or other biasing members.

In some embodiments, one or more rest positions may correspond to a substantially singular overall rotational position of the compound swivel portion. In some embodiments, one or more rest positions may correspond to a continuous range of overall rotational positions of the swivel portion, said range being a subset of the possible rotational positions of the swivel portion. Rest positions may be provided for rotational positions of the compound swivel portion which correspond to engagement of at least some of the swivel stop members, and/or for rotational positions which correspond to the swivel stop members being unengaged.

In some embodiments, the compound swivel portion may be moved out of a rest position or through a continuum of rest positions by applying rotational force or torque greater than a predetermined threshold. The threshold may be configured, for example, such that it may be exceeded conveniently by hand manipulation, but is sufficiently high to resist a substantial proportion of accidental impacts, bumps or jars to the apparatus. In some embodiments, the threshold is configured to be sufficient to maintain an orientation of the apparatus and a peripheral device coupled thereto. In addition, in some embodiments, the apparatus is configured in order to provide adjustability of the threshold, for example by the adjustment of the contact force between the swivel members, which may be provided by a screw type mechanism. In some embodiments, the compound swivel portion may be configured so that moving it out of a rest position requires additional actions, such as manipulation of a latch or switch, application of force along the swivel axis, for example to pull swivel members away from each other to disengage from a rest position, or the like.

Peripheral Portion

The computer port interface apparatus includes a peripheral portion. The peripheral portion extends from the third swivel member, for example being integrally formed or rigidly connected thereto.

The peripheral portion is operatively coupled, via the compound swivel portion, to the computer port connector portion for interface to the computer port. Thus, computer signals, power, ground, or a combination thereof, may be routed between a computer device and the peripheral portion, and between the peripheral portion and a peripheral device integrally formed or operatively coupled thereto. Generally, such a peripheral device is orientation-sensitive, so as to benefit from the compound swivel capability to change orientation. Furthermore, the peripheral device is typically of a weight, size and shape to be adequately supported by the apparatus.

In some embodiments, the peripheral portion and computer port connector portion may each comprise one or more conductors, such as conductors carrying power and/or signals, and a signal pathway may couple conductors of the peripheral portion to conductors of the computer port portion.

In some embodiments, the peripheral portion further comprises integral electronics, such as a wireless network interface, wireless modem, or other device such as cameras, directional microphones, peripherals comprising infrared or other line-of-sight communication portions, speakers, fans, and the like.

In some embodiments, the peripheral portion further comprises a computer port connector for mated coupling with a peripheral device. For example the computer port connector portion may include a male USB™ type-A connector or other connector. More generally, the peripheral portion may include a male or female portion of a port connector such as a serial, parallel, USB™ (type A, type B, standard, mini, micro, or the like), Firewire™, PS/2, RJ-485, Centronics™ port, parallel port, IEEE 1284 port, DB-9, DB-25, audio port, video port, VGA port, DVI port, SCSI port, Ethernet port, mini-DIN port, or other standard, custom or proprietary computer port providing power, data, or a combination thereof, or the like.

In embodiments of the invention, the peripheral portion comprises one or more conductive contacts for mating with corresponding conductive contacts of a computer port connector. For example, USB™ connectors typically comprise four conductive contacts: two for providing a differential serial signal connection, one for providing power, and one for providing ground. The conductive contacts may each be electrically connected to corresponding conductors which extend into the peripheral portion, and from there are operatively coupled to corresponding conductors of the computer port connector portion. Operative coupling may be provided by one or more conductors such as flexible wires passing through the compound swivel portion, or other means which allow for substantially uninterrupted coupling when the swivel portion is oriented in two or more different swivel positions.

In some embodiments, the computer port connector of the peripheral portion is a corresponding mating connection to the computer port connector of the computer port connector portion. This allows the computer port interface apparatus to act as an optional computer port adapter for facilitating desired orientation of a peripheral device, by coupling the apparatus in between the computer device and the peripheral, instead of directly attaching the peripheral to the computer device.

In some embodiments, the peripheral portion extends from the third swivel portion along a main axis of the peripheral portion. For example the two portions may be integrally formed with or rigidly connected with each other. In some embodiments, a single housing component is common between a portion of the peripheral portion and the third swivel portion. The single housing component may include a bend, such as a 135° bend, which, in embodiments, may be coincident with a boundary between the peripheral portion and the swivel portion.

Apparatus Shape

As discussed herein, the computer port connector portion, swivel portion, and peripheral portion may be configured to provide a desired overall shape of the apparatus. For example, the apparatus may be shaped such that the computer port connector portion and peripheral portion are generally parallel at a first swivel position, and generally perpendicular at a second swivel position. The first and second positions may correspond to swivel positions at limits of the swivel range of motion, for example. In some embodiments, the swivel portion may be configured having its swivel axis forming an angle of about 45° to main axes of the computer port connector portions and the peripheral portions.

In some embodiments, the computer port connector portion may be operatively coupled to a host computer system such as a laptop, the computer port connector portion extending in a predetermined direction from the host computer system, for example outward from the side. The peripheral portion may then be oriented in one orientation, for example parallel, relative to the computer port connector portion and hence the plane of the host computer system in the first swivel position, and in another orientation, for example perpendicular, to the computer port connector portion and hence the plane of the host computer system in the second swivel position. In embodiments wherein the peripheral portion includes or is operatively coupled to radio-enabled peripheral device having an antenna, such as a radio transmitter, network adapter or wireless modem, the antenna may be reoriented relative to a user of the host computer system by operation of the compound swivel. Depending on the position of the user with respect to the host computer system, and the radiation pattern of the antenna, either the first or second swivel position, or an intermediate position, may be selected to provide for lower levels of radiation emitted toward a user of the device. This may desirably reduce the specific absorption rate (SAR) measurement of radiation levels absorbed by body tissue, which may facilitate a desirably low SAR associated with radio-enabled peripheral device operation, which may facilitate regulatory compliance, for example.

In some embodiments, the first swivel position may correspond to the peripheral portion extending parallel to a host laptop computer and outward over the lap of a use, and the peripheral portion may include or be operatively coupled to radio-enabled peripheral device having an antenna, the antenna having a radiation pattern such that radiation is emitted toward the user's lap when the apparatus is in the first swivel position. In some embodiments, radiation and SAR measurement thereof may be reduced due to the shape of the apparatus. For example, the compound swivel portion may extend from the computer port connector portion generally away from the user's lap, along the swivel axis, thereby providing an increase in distance between the peripheral portion and the user's lap, which may reduce irradiation of the user due to increased distance between the user and the antenna. The length of the compound swivel portion may be configured to provide a desired separation between the user and the peripheral device antenna to reduce user irradiation by said antenna. This may facilitate a desirably low SAR associated with the peripheral device operation, which may facilitate regulatory compliance, for example.

In some embodiments, the present invention provides a compound swivel having three or more swivels. For example, the second swivel member, situated between the first and third swivel members, may itself comprise one or more swivels, and may be viewed as having two, three or more swivel sub-members in swivelling engagement. Each swivel included in the second swivel member may also comprise a swivel stop assembly. In this manner, total relative rotation of the first and third swivel members may be made as large as desired by providing an appropriate number of swivels, but this may be limited due to operative interconnectivity of the computer port connector portion and the peripheral portion.

In some embodiments, the diameter of the compound swivel and component portions thereof may be substantially large. For example, the diameter of the compound swivel portion may be about one centimetre.

In some embodiments, the computer port interface apparatus is constructed such that the compound swivel portion is substantially resistant to breakage. For example, the diameter of the compound swivel and component portions thereof may be sufficiently large to impart a predetermined strength to the computer port interface apparatus, such that the compound swivel is substantially resistant to breakage due to bending transverse to the swivel axis. The compound swivel may further include structural components designed to provide increased resistance to breakage.

In some embodiments, the computer port interface apparatus may comprise one or more housing portions being formed of or coated with a conductive material such as metal. The housing portions may house one or more of the peripheral portion, compound swivel portion, and computer port connector portion. The housing portions may include a relatively large surface area, for example due to a relatively large diameter of the compound swivel portion. In embodiments wherein the peripheral portion includes or is operatively coupled to a radio-enabled peripheral device such as a radio transmitter, network adapter or wireless modem, the conductive material may be configured to circulate radio-frequency (RF) currents associated with operation of the radio-enabled peripheral device. For example, when an antenna of the radio-enabled peripheral device is operating to transmit information, RF currents may be induced in the conductive material of the housing portions. Since the housing portions have a relatively large surface area, the RF currents may be less concentrated than would otherwise be required if the RF currents were confined to internal conductors of the apparatus. This may result in lower impedance to RF currents associated with operation of the radio-enabled peripheral device. This may also result in lower levels of radiation emitted toward a user of the device, which may desirably reduce the SAR measurement of radiation levels absorbed by body tissue. This may facilitate a desirably low SAR associated with peripheral device operation, which may facilitate regulatory compliance, for example.

In some embodiments, the compound swivel portion may be configured to conduct heat between the computer port connector portion and the peripheral portion, for example by including heat conducting materials such as metal therein. This may facilitate operation of a peripheral device, such as a radio-enabled peripheral device, having relatively high heat-sinking requirements. In some embodiments, the diameter of the compound swivel and components thereof may be sufficiently large to facilitate including heat conductive components having a desirably large cross-sectional area, thereby facilitating a desirable amount of heat conduction capacity between the computer port connector portion and the peripheral portion.

In some embodiments, the diameter of the compound swivel and component portions thereof may be sufficiently large so as to facilitate ease of assembly, for example the compound swivel may be 1 cm in diameter or greater. For example, by providing a compound swivel having a large diameter or cross-sectional area, the swivel members, swivel stop members, and other components of the compound swivel may be made correspondingly large. Large size may facilitate ease of assembly by enabling simplified assembly machinery to be used, or by enabling ease of assembly by hand.

The invention will now be described with reference to specific examples. It will be understood that the following examples are intended to describe embodiments of the invention and are not intended to limit the invention in any way.

Examples

Figure 7:
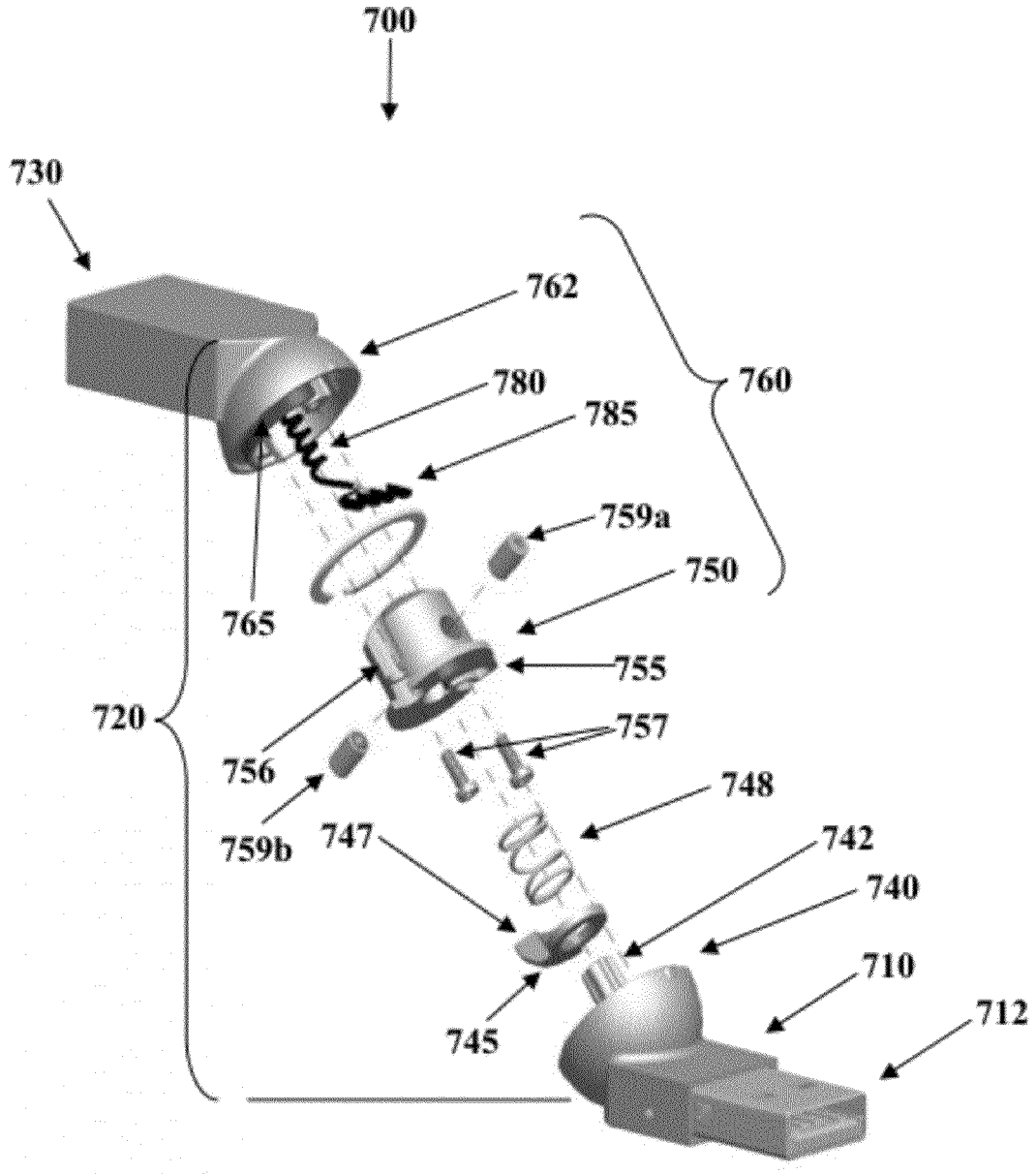
FIG. 7 illustrates an exploded view of a computer port interface apparatus in accordance with an embodiment of the present invention.

FIG. 7 illustrates an exploded view of a computer port interface apparatus 700 in accordance with an embodiment of the present invention. The apparatus 700 comprises a computer port connector portion 710 comprising a male USB™ type A connector 712 for mated coupling with the USB™ computer port of a host computer system such as a laptop computer. The computer port connector portion 710 extends from a first swivel member 740 of a compound swivel portion 720 of the apparatus 700 at an oblique angle of about 135°. The apparatus 700 further comprises a peripheral portion 730, which may include a female USB™ type A connector for operative coupling with a peripheral device, such as a wireless modem. Alternatively, the peripheral portion 730 may include an integral peripheral device. The peripheral portion 730 extends from a third swivel member 760 the compound swivel portion 720 at an oblique angle of about 135°.

The compound swivel portion 720 includes a first swivel member 740 in swivelling engagement with a second swivel member 745. The second swivel member is a washer-like body positioned between the first swivel member 740 and the third swivel member 760. A spring 748 is provided as a spacer between the second and third swivel members 745 and 760. The first swivel member includes a generally cylindrical protrusion 742 upon which the second swivel member 745 is fitted. As illustrated, the protrusion 742 includes a plurality of grooves oriented parallel to the swivel axis.

A first swivel stop assembly operates to limit relative rotation of the first and second swivel members 740 and 745. The first swivel stop assembly comprises a raised stop body interior to the cavity defined by swivel member 740 (not shown) which is coupled to the first swivel member 740, and a raised stop body 747 formed with the second swivel member 745. The stop members are configured to engage each other to limit relative rotation of the first swivel member 740 and the second swivel member 745. Each stop body may be subtended by an angle of about 90° in the swivel plane, thereby allowing for about 180° of relative motion between the first and second swivel members 740 and 745.

The compound swivel portion 720 includes the second swivel member 745 in swivelling engagement with the third swivel member 760. The third swivel member 760 includes a housing 762 integrally formed with the peripheral portion 730, and an assembly 750 which is attached to the housing 762 via screws 757. The housing 762 includes a ring 765 protruding from the interior of a cavity defined by housing 762. The ring 765 fits into the housing of the first swivel member 740 to provide structural strength to the compound swivel portion 720 and keep dirt out. The assembly 750 includes a detent mechanism comprising two ball springs 759*a* and 759*b* which are fitted into apertures of a flange portion 756 of the assembly 750. The ball springs 759*a* and 759*b* include spring mounted ball bearings which engage the grooves of protrusion 742 to provide a ball detent.

A second swivel stop assembly operates to limit relative rotation of the second and third swivel members 745 and 760. The second swivel stop assembly comprises stop body 747 integrally formed with the second swivel member 745, and stop body 755 integrally formed with assembly 750 of the third swivel member 760. The swivel stop bodies 747 and 755 protrude toward each other and are configured to engage to limit relative rotation of the second and third swivel members 745 and 760. Each stop body 747 and 755 may be subtended by an angle of about 90° in the swivel plane, thereby allowing for about 180° of relative motion between the second and third swivel members 745 and 760.

The compound swivel portion 720 may be configured with a desired compactness and strength, for example. The compound swivel action in the present example allows 360° of total swivel movement between engagements of the swivel stop assemblies. This provides a greater range of motion than a single swivel of the same type would provide.

The elements of the compound swivel 720 define a hollow centre channel through which wires 780 of the four USB™ electrical connections may be passed to provide operative coupling of the computer port connector portion 710 and the peripheral portion 730. The wires terminate in connectors 785 which can be coupled to the USB™ connector 712. As shown, the wires 780 are coiled for improved resistance against damage due to swivel motion. The action of the swivel stop assemblies further reduces potential for damage by limiting swivel action to a predetermined angular range.

The compound swivel allows reorientation of the peripheral portion 730, for example between a generally horizontal position and a generally vertical position, when the computer port connector portion 710 is mated with a USB™ port on the side of a host computer. This allows reorientation of the peripheral portion 730 for example to improve operation of an antenna thereof and/or reduce undesired irradiation of a user, if the peripheral portion includes or is coupled to an antenna.

It is obvious that the foregoing embodiments of the invention are examples and can be varied in many ways. Such present or future variations are not to be regarded as a departure from the spirit and scope of the invention, and all such modifications as would be obvious to one skilled in the art are intended to be included within the scope of the following claims.

I claim:

1. A computer port interface apparatus comprising:

a.) a computer port connector portion configured for mated coupling with a computer port;

b.) a compound swivel portion comprising:

i.) a first swivel member, the computer port connector portion extending from the first swivel member;

ii.) a second swivel member in swivelling engagement with the first swivel member;

iii.) a first swivel stop assembly operatively coupled to the first and second swivel members, the first swivel stop assembly configured to limit relative rotation of the first and second swivel members to a first range;

iv.) a third swivel member in swivelling engagement with the second swivel member; and v.) a second swivel stop assembly operatively coupled to the second and third swivel members, the second swivel stop assembly configured to limit relative rotation of the second and third swivel members to a second range; and c.) a peripheral portion extending from the third swivel member, the peripheral portion operatively coupled to the computer port connector portion for interface to the computer port.

2. The computer port interface apparatus according to claim 1, wherein the peripheral portion comprises a peripheral electronic device.

3. The computer port interface apparatus according to claim 2, wherein the peripheral electronic device is an orientation-sensitive device selected from the group comprising: wireless network interface devices, devices comprising an antenna, camera devices, directional microphone devices, peripheral devices comprising an infrared communication portion, speaker devices, and fan devices.

4. The computer port interface apparatus according to claim 1, wherein the peripheral portion is configured for mated coupling with a peripheral electronic device.

5. The computer port interface apparatus according to claim 1, wherein the compound swivel portion defines a channel, the channel accommodating a signal pathway electrically connecting the computer port connector portion and the peripheral portion.

6. The computer port interface apparatus according to claim 5, wherein the signal pathway comprises one or more conductors selected from the group comprising: flexible wires, coiled wires, uncoiled wires, bundled wires, unbundled wires, and signal traces.

7. The computer port interface apparatus according to claim 1, wherein the first, second and third swivel members are configured for swivelling engagement about a swivel axis, the computer port connector portion extends from the swivel axis at a first oblique angle, and the peripheral portion extends from the swivel axis at a second oblique angle.

8. The computer port interface apparatus according to claim 7, wherein the first oblique angle and the second oblique angle are substantially 135 degrees.

9. The computer port interface apparatus according to claim 1, wherein the first range and the second range sum substantially to a value from 180 degrees to 720 degrees.

10. The computer port interface apparatus according to claim 1, the second swivel member further comprising two or more swivel sub-members in swivelling engagement and configured for relative rotation within one or more additional ranges.

11. The computer port interface apparatus according to claim 1, wherein one or both of the first swivel stop assembly and the second swivel stop assembly comprises one or more swivel stop mechanisms selected from the group comprising: a rigid body, an elastically deformable body, and a pair of repelling magnets.

12. The computer port interface apparatus according to claim 1, wherein the compound swivel is configured to have one or more predetermined rest positions, wherein relative rotation of the first, second, and third swivel members is substantially impeded when in one of the one or more predetermined rest positions.

13. The computer port interface apparatus according to claim 1, wherein the compound swivel portion is rotatable between a first swivel position and a second swivel position, the peripheral portion substantially parallel to the computer port connector portion in the first swivel position, the peripheral portion substantially perpendicular to the computer port connector portion in the second swivel position.

14. The computer port interface apparatus according to claim 1, the computer port interface apparatus shaped to facilitate a spaced-apart configuration between the peripheral portion and a user of a laptop computer when the computer port connector portion is operatively coupled to the laptop computer.

15. The computer port interface apparatus according to claim 1, the computer port interface apparatus comprising one or more conductive housing portions configured for conducting radiofrequency currents, the conductive housing portions having a predetermined surface area configured for dispersal of said radiofrequency currents.

16. The computer port interface apparatus according to claim 1, the compound swivel portion further configured to conduct heat between the computer port connector portion and the peripheral portion.

17. The computer port interface apparatus according to claim 1, wherein the computer port connector portion comprises a male or female portion of a port connector selected from the group comprising: a serial port connector, a parallel port connector, a USB™ type A port connector, a USB™ type B port connector type B, a a USB™ standard port connector, a USB™ mini port connector, a USB™ micro port connector, a Firewire™ port connector, a PS/2 port connector, a RJ-485 port connector, a Centronics™ port connector, a IEEE 1284 port connector, a DB-9 port connector, a DB-25 port connector, an audio port connector, a video port connector, a VGA port connector, a DVI port connector, a SCSI port connector, an Ethernet port connector, and a mini-DIN port connector.

18. The computer port interface apparatus according to claim 1, wherein one or more of the first swivel member, the second swivel member, and the third swivel member are generally cylindrically, hemispherically, or frustro-conically shaped.

19. The computer port interface apparatus according to claim 1, the compound swivel portion further comprising one or more components facilitating swivelling engagement between one or both of: the first swivel member and the second swivel member; and the second swivel member and the third swivel member, said one or more components selected from the group comprising: bearing assemblies, tongue and groove assemblies, washers, spacers, frictional surfaces, and springs.

* * * * *